United States Patent [19]

Adler

[11] Patent Number: 4,623,470

[45] Date of Patent: Nov. 18, 1986

[54] PROCESS AND APPARATUS FOR SEPARATING OR FRACTIONATING FLUID MIXTURES

[75] Inventor: Robert J. Adler, Cleveland, Ohio

[73] Assignee: Helipump, Inc., Cleveland, Ohio

[21] Appl. No.: 319,132

[22] Filed: Nov. 9, 1981

[51] Int. Cl.[4] ..... B04B 5/00

[52] U.S. Cl. ..... 210/787; 210/138; 210/512.3; 494/11

[58] Field of Search ..... 210/633, 635, 657, 695, 210/739, 774, 781, 748, 787, 789, 198.2, 222, 138, 511, 512.3; 422/257–259; 494/11, 42, 84

[56] References Cited

U.S. PATENT DOCUMENTS

| | | | |
|---|---|---|---|
| 1,610,725 | 12/1926 | Andrews | 210/787 |
| 2,988,429 | 6/1961 | Cooley | 422/257 |
| 3,192,126 | 6/1965 | Fear | 422/256 |
| 3,368,874 | 2/1968 | Wilhem | 210/774 X |
| 3,498,533 | 3/1970 | Schomburg | 494/84 |
| 3,554,380 | 1/1971 | Karpacheva | 210/748 X |
| 3,616,911 | 11/1971 | Rodrigues | 210/787 |
| 3,709,665 | 1/1973 | Coulson | 422/257 |
| 3,771,654 | 11/1973 | Meissner | 210/787 |
| 4,039,456 | 8/1977 | Stoek et al. | 210/748 |
| 4,151,089 | 4/1979 | Ito | 210/511 X |
| 4,151,844 | 5/1979 | Cullis | 210/789 |
| 4,238,327 | 12/1980 | Liburdy | 210/198.2 |
| 4,287,061 | 9/1981 | Sutherland | 210/198.2 |
| 4,299,701 | 11/1981 | Garrett et al. | 210/222 |
| 4,305,907 | 12/1981 | Baird | 210/511 |

FOREIGN PATENT DOCUMENTS

| | | | |
|---|---|---|---|
| 47-35187 | 4/1972 | Japan | 210/748 |
| 0571292 | 9/1977 | U.S.S.R. | 422/257 |

*Primary Examiner*—John Adee

*Attorney, Agent, or Firm*—Woodling, Krost & Rust

[57] ABSTRACT

Process for separating fine particles (fines) from a slurry of such fine particles in a liquid by a combination of centrifugal or other separative force and axial or longitudinal flow imparted to the slurry producing secondary flows of the slurry, and apparatus for utilization of the process, including a conduit (11) having a helical or curved portion (12) through which the slurry passes, rotating means (14) for spinning the helical portion, pumping means (15) for imparting an axial flow to the slurry, and control means (16) for controlling to obtain alternate direction of the axial flow towards the opposite ends of the helical portion.

10 Claims, 12 Drawing Figures

PROCESS AND APPARATUS FOR SEPARATING OR FRACTIONATING FLUID MIXTURES

FIELD TO WHICH INVENTION RELATES

My invention relates to the separation or fractionation of fluid mixtures. It is directed to the concentration of slurries, emulsions, and molecular mixtures, and also to their fractionation into portions of different composition.

BACKGROUND ART OF THE INVENTION

The related background art known to applicant but which does not teach, disclose, or suggest the present invention includes separation by filtering, evaporation, settling, centrifugation, precipitation, distillation, adsorption, ion exchange, extraction, crystallization, chromatography, parametric pumping, and field flow fractionation.

Most of the above methods are fundamentally steady-state in character in the sense that continuous flow versions of the methods operate steadily in time after an initial transient period of start-up; in the absence of disturbances the state of the system becomes independent of time. In fact, control means are normally appended, an important object of which is the maintenance of steady product quality in the presence of external disturbances.

In contrast, the invention is a method of separation which is fundamentally periodic in character in the sense that the process always operates in the unsteady-state; it is fundamentally cyclic in its operation.

Also, most of the above methods are limited to one particular separative force. In contrast, the invention is a broadly applicable method of operation which can employ a variety of separative forces and can therefore be used on a wide variety of mixtures of materials.

The invention is most closely related to two of the above methods, parametric pumping and field flow fractionation.

In 1968, Wilhelm and co-workers introduced the parametric pumping process. Parametric pumping combines alternating fluid displacement in a straight column with an alternating, intensive, physical parameter such as temperature, pressure, or pH to separate molecular mixtures. For example, in thermal parametric pumping an alternating temperature causes adsorption and desorption of molecules within cross-sections on solid packing. Alternating fluid displacement, in one direction while the molecules are adsorbed, and in the other direction while the molecules are desorbed, taking advantage of compositional differences between adsorption and desorption equilibria, effects the separation. A closely related method called pressure-swing adsorption is used commercially to produce enriched oxygen from air.

Thus, parametric pumping employs two out-of-phase periodic actions: periodic variation of an intensive variable, typically temperature, and periodic forward and backward flow. The periodic variation of both the intensive variable and the flow are essential; without both, parametric pumping is inoperable.

The new invention differs from parametric pumping in that it uses a steady separative force rather than a periodic one, and specially modulated and controlled back-and-forth flows rather than symmetric periodic flows. The special back-and-forth flows bring about local periodic mixing and resuspension of the species being separated or fractionated, and also transport the species being separated along the conduit in which the process is being conducted. The local periodic mixing is enabled by a curved conduit, such as a helical tube, and/or flows which are asymmetric in their velocity. A species mixed or suspended in the fluid is transported by the motion of the fluid in one direction, and when the same species is adjacent to a solid boundary the other components are transported by the fluid in the opposite direction.

The invented method is usually orders-of-magnitude faster than, e.g. thermal parametric pumping because the invented method can use action-at-a-distance (body) forces as separative forces while thermal parametric pumping usually uses heat conduction and mass transfer, which are slow, diffusion limited processes. Each cycle in the invented method typically requires only a few seconds, while tens of minutes are needed typically for each cycle of thermal parametric pumping.

Field Flow Fractionating (FFF), a chromatographic method for fractionating macromolecules and fine particles, was conceived by J. C. Giddings in about 1965. A field acts perpendicular to flow through a narrow channel, forcing particles toward a wall. Simultaneously, diffusion tends to redisperse the particles. The particles least affected by the field, and most dispersed by diffusion in the cross section move downstream most quickly. A pulse of a mixture dispersed or dissolved in a fluid carrier which flows steadily through a tube will thus emerge in several fractions or peaks, as in chromatography. Giddings and others employed various types of external fields, yielding the following FFF subclasses: Sedimentation (centrifugal), Thermal, Thermogravitational, Flow (pressure gradient causes cross flow through membrane walls), Concentration, and Magnetic.

Sedimentation FFF is the version most closely related to the main example of the new invention presented shortly. In Sedimentation FFF, the flow channel is a helical tube within a centrifuge bowl. A rectangular cross section with a large aspect ratio is used to minimize secondary flow. Berg and Purcell developed a similar procedure prior to Giddings, but used a straight tube spinning on its axis rather than a helix. Sen has also recently used a spinning straight tube. About 1969, International Equipment Company (IEC), now Damon Industries, attempted to develop the "Helixtractor" unit for use with its centrifuges. The unit was intended for semi-continuous separation of red blood cells from blood; its principle of operation resembled Sedimentation FFF. Blood flowed unidirectionally through a helical tube in a centrifuge bowl. The object was to force red blood cells to the tube wall and collect them there in a semi-batch mode of operation, allowing passage of white blood cells. It was found, however, that unless axial flow rates were very small, that secondary flows resuspended the red blood cells, thwarting commercial practicality.

The new slurry fractionation method differs from Giddings' FFF in that rapidly alternating rather than fundamentally unidirectional flows are used, and in that the separated products are produced essentially in a steady fashion at opposite ends of the apparatus, while in FFF the products are produced in an essentially sequential series of pulses at one end of the apparatus. Also, periodic secondary flows are employed advantageously as an essential part of the new invention, rather than being suppressed as is critical to FFF. The new method can concentrate as well as separate fractions, while chromatographic methods such as FFF produce the separated species diluted in carrier fluid.

Examples of background art, but which differ from the present invention, are found in U.S. Pat. Nos. 3,449,938 and 4,147,621.

STATEMENT OF THE INVENTION

There is a need in industry for separating fine particles, sometimes called "fines", from a slurry of liquid containing the fine particles in suspension. Sometimes it is desired to fractionate fine particles of different sizes and densities suspended in a liquid making up the slurry. In natural and synthetic emulsions and in liquid-liquid extraction processes, including versions which employ liquid membranes, there is a need to separate and sometimes fractionate liquid droplets. There is also a need in industry for separating molecules from a molecular mixture. Often it is desired to fractionate a mixture of molecules according to their size or molecular density.

An object of the invention is to provide an efficient and economical process and apparatus for filling these needs.

Another object is to provide a system readily adapted to the requirements of industry for the handling and disposition of fine solid or liquid particles suspended in a fluid, or molecular mixtures.

Another object is the provision of means for salvaging fine solid or liquid particles suspended in a fluid.

Another object is the provision of means for recovering fluids free of particles.

Another object is the separation or fractionation of a molecular mixture into portions of different composition.

Some examples of such slurries, emulsions, and molecular mixtures are fine particles of coal or coal dust suspended in water, particles of grinding composition and particles of metal ground off in a grinding operation suspended in a liquid, mineral particles of varying sizes and densities in water, mineral particles in synthetic oil made by liquefying coal or retorting oil shale, dispersions of liquid droplets, dispersions of biological particles obtained by rupturing blood platelets, protein solutions, solutions of biologically active materials, and solutions containing isotopes.

The apparatus and process is based on the discovery that fluid mixtures (slurries, emulsions, and molecular mixtures) can be separated by combining two factors: (1) a steady separative force which acts to produce a concentration gradient perpendicular to the walls of the containing tube, such as a steady centrifugal, magnetic, or electric field, and (2) periodic flow through the tube composed of cycles containing at least one step of forward flow and one step of backward flow, and usually also a step of zero flow, where the periodic flow and geometry are such as to interact to produce periodic local mixing, as for example flow through a curved tube which induces secondary flows perpendicular to the tube wall, or asymmetric flows through a straight tube which are periodically laminar and turbulent. The basic phenomena bringing about the separation are believed to be migration of species perpendicular to the tube wall under the influence of the separative force which causes one or more species to concentrate along a solid surface in each cross-section, and convective transport of particles, droplets, or molecules along the tube by the imposed periodic fluid flows.

In the example here given to illustrate an embodiment of the invention, a slurry of fine particles of iron oxide, having an average diameter of one micron suspended in water, is treated by the apparatus and process. The invention is used to split the slurry into two portions, one portion being liquid relatively free of the fine particles, and a second portion being a relatively concentrated slurry containing most of the particles.

The example is one of batch operation in a curved tube, but it can be extended readily to continuous flow operation and straight tubes as described later. Each cycle of periodic operation consists of three steps: step "a" of zero flow; step "b" of flow in a first direction through the helical tube; and a step "c" of flow in a second (opposite) direction through the helical tube. The steps are sequential and form a cycle which is repeated indefinitely to bring about the separation. Throughout all of the steps and cycles the helical tube spins steadily about its axis causing the slurry contained in the tube to be subjected to a constant centrifugal force field.

During step "a" the centrifugal force causes particles to move radially outward toward the outer wall of the helical tube, i.e. the portion of the tube wall farthest from the helical tube axis, where they become relatively concentrated.

In step "b", fluid is transported by pumping in a first direction through the helical tube. Generally the volume pumped is less than the volume of the helical tube. During the initial part of step "b" the particles continue to be located adjacent to the tube wall and are therefore temporarily immobilized with respect to axial flow. Thus the fluid moved along the helical tube by the pumping is relatively free of particles. As time passes within step "b", the axial flow begins to induce secondary flows or cross-currents within the helical tube which resuspend the fine particles that had been concentrated along the outer wall of the tube. Step "b" is terminated when the developing secondary flows have resuspended the particles.

In step "c", the flow is reversed through the helical tube by pumping in the opposite direction. Generally the volume of fluid displaced is again at most the volume of the helical tube. Secondary flow again keeps the particles substantially resuspended so the particles are carried backwards with the fluid.

Separation occurs because the fluid moving in step "b" in a first direction is substantially free of particles while fluid moving in step "c" in the second (opposite) direction is relatively concentrated in particles. In other words, the particles lag behind the axial fluid motion in step "b", but move more nearly in phase with the axial fluid motion in the reverse direction in step "c". The repetition of cycles consisting of steps "a", "b" and "c" enable even a slight amount of separation in the cross-sections to be cascaded into a large separation between the ends of the tube. Liquid accumulates free of fine particles in the reservoir adjacent the end of the helical tube toward which the flow is directed in step "b", and concentrated slurry accumulates in the reservoir adjacent the opposite end of the helical tube toward which the flow is directed in step "c".

The above example is one where a slurry is separated into a concentrated fraction and a lean fraction. Different sequences of steps with different step durations in the cycles enable slurries to be fractionated into portions according to particle size or density and enable emulsions or molecular mixtures to be separated or fractionated. Such sequences are discussed and examples given after describing the drawings and an apparatus.

FIGURES OF THE DRAWINGS

FIG. 1 is a diagrammatical showing of a simple arrangement for practicing the invention, it being understood that more complex and involved systems may be utilized which embody the principles of the invention. In FIG. 1 the apparatus illustrates the operation at the end of an initial step "a", during which the helical portion of the conduit is being spun but there is no pumping of the slurry and no axial flow of the slurry;

Figure 1:
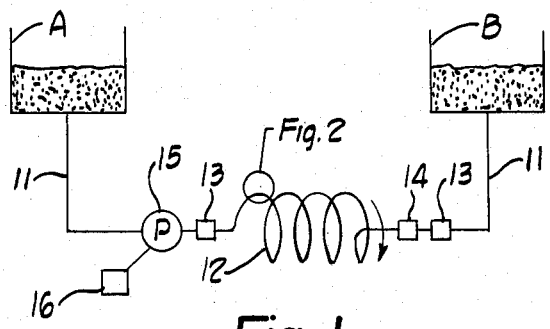

In the drawings, the density of the slurry, that is the concentration of fine particles in the liquid, is illustrated by a plurality of small dots at indicated locations. This showing is, of course, diagrammatical.

DESCRIPTION OF THE INVENTION HEREIN DISCLOSED

In the apparatus shown, in the preferred form of the invention, there is a first reservoir or receptacle A and a second reservoir or receptacle B that are in communication with each other through a conduit 11, which may be a tube or the like.

Slurry to be operated on is placed into the reservoirs or receptacles A and B to fill them and the interconnecting conduit 11 to the point that the reservoirs or receptacles are partially and substantially equally filled, about as shown in FIG. 1.

The conduit 11 has an intermediate portion 12 formed into the form of a helix, which may be a cylindrical helix, or a conical helix, or a flat wound spiral, although a cylindrical helix is preferred.

To permit the helical portion 12 to rotate or spin on its axis relative to the stationary portion of the conduit 11, rotary seals 13 are mounted at the opposite ends of the helical portion 12. These seals are of well known construction and permit this rotation or spinning without leakage of the slurry contained in the conduit.

For rotating or spinning the helical portion 12 on its axis, a rotator 14 is operatively connected to the helical portion to rotate the same on its axis. The rotator may include gearing driven by a motor, such as an electric motor, or other suitable driving means for providing a relatively fast rotation or spinning of the helical portion on its axis.

A pump 15 is mounted in the conduit 11 outwardly of the helical portion 12. The pump 15 is of the reversible type and is adapted to alternately pump slurry through the conduit, including the helical portion 12, in opposite directions. When operating in one phase, the pump 15 pumps the slurry to impart an axial flow of the slurry in the helical portion toward the right as in FIG. 3. When operating in a reverse phase, the pump 15 pumps the slurry to impart an axial flow of the slurry in the helical portion toward the left as in FIG. 5.

A controller 16 is operatively connected to pump 15 to control its operation. The controller includes operation means for causing the pump to operate in a cyclic fashion; each cycle consists of a step "a" during which the pump is off, a step "b" during which the pump causes fluid to be transported through the helical tube in a first direction (such as to the right), and a step "c" during which the pump causes fluid to be transported through the helical tube in a second direction (such as to the left) opposite to the first direction, and timing means for controlling the time periods during which the pump is not operating, during which the pump is operating to pump slurry in one direction, and during which the pump is operated to pump slurry in the opposite direction. The preferred control means is a microprocessor with an internal clock, programmable memory, keyboard, and appropriate interfaces.

Operation

The process and use of the operation, in the preferred form of FIGS. 1 to 6, inclusive, is commenced by supplying the slurry containing in suspension the fine particles to be separated to the reservoirs A and B and thus concurrently filling the conduit 11. The pump 15 is initially operated so that the entire conduit 11, including the helical portion 12, is filled with the slurry. The reservoirs A and B are substantially equally filled, such as one-half full each, about as shown in FIG. 1. After filling of the system the operation of the pump is terminated until the process is commenced as follows.

The rotator 14 is then operated to cause the helical portion 12 to spin or rotate rapidly on its axis. The faster the spinning consistent with the strength and construction of the apparatus, the better. For a period of time the spinning continues while the pump 15 is still dormant, that is while the pump is not imparting axial flow of the slurry in the helical portion in either direction. This spinning of the helical coil imparts a centrifugal force upon the slurry in the helical portion and this induces the fine particles in the slurry to move radially outward toward the outer walls of the helical portion, that is toward the part of the helical tube wall farthest from the axis of the helix.

Figure 2:
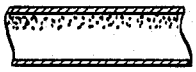
FIG. 2 illustrates the condition of the slurry at a cross-section of the conduit, indicated as location 2 in FIG. 1.

The fine particles in the slurry under the influence of centrifugal force during this initial period become concentrated in the slurry near the said outer walls, as diagrammatically illustrated by the dots within the conduit shown in FIG. 2. At the same time the slurry inwardly of this concentration of fine particles is relatively clear or diluted as illustrated by the low density of dots shown within the conduit shown in FIG. 2.

Figure 3:
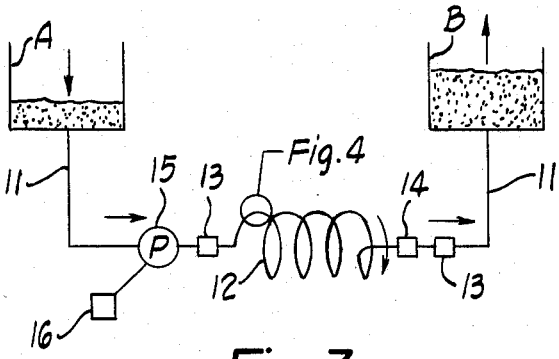
FIG. 3 is a diagrammatical showing of the apparatus as shown in FIG. 1 which shows the operation of the pumping means to impart, while the helical portion of the conduit is still being spun, an axial flow of the slurry toward one end of the helical portion, that is toward the right in FIG. 3. The state of the apparatus shown is at the end of step "b"

After a period of time sufficient for the centrifugal force field to cause separation of the particles to occur in the helical tube cross-section, as shown in FIG. 2, and without the intervention of any axial flow imparted to the slurry, then the controller 16 operates to cause the pump 15 to propel the slurry in a first direction through the conduit so as to impart an axial flow of the slurry in said first direction, such as to the right in FIG. 3. The spinning of the helical coil by the rotator 14 is continued during this subsequent pumping and axial flow of the slurry through the helical portion.

During the period of time in which the axial flow imparted to the slurry is in the first direction, such as to the right in FIG. 3, the level of the slurry in reservoir A is lowered and the level of the slurry in reservoir B is raised. Also the slurry in reservoir B has become more diluted.

At this stage, the axial flow induced by pump 15 has forced clearer liquid from the helical tube 12 to the right where it rises in reservoir B. In the step shown in FIG. 3, the reservoir B has an increased amount of clearer liquid or less dense slurry pumped into it. At the same time, the reservoir A has drawn from it some of the slurry contained in it and its level has fallen as indicated by the example in FIG. 3. This operation of the pump thus moves more relatively clear liquid to reservoir B than slurry containing fine particles. The centrifugal force imparted to the slurry and the axial flow to the right imparted by the pump combine in their action to remove liquid from the slurry while leaving fine particles suspended in the slurry near the outer walls out of the way of the movement of the clearer liquid.

Figure 4:
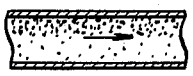
FIG. 4 illustrates the condition of the slurry at a cross-section of the conduit, indicated as location 4 in FIG. 3.

This step of the pumping wherein the slurry is pumped in one direction in the helical portion 12, such as to the right in FIG. 3, is for a relatively short period of time (such as generally in the range of 0.1 to 10 seconds). The controller 16 has its mechanism or computer program set for operating the pump at this step of the cycle for this relatively short period of time. During this step of pumping, the axial flow and the spinning motion interact to cause cross-currents or secondary flows perpendicular to the axial direction to develop. The secondary flows, when they reach sufficient strength, begin to resuspend some of the fine particles near the outer wall of the conduit into the liquid inward of the outer wall, as shown in FIG. 4 which depicts the state when the step of pumping to the right illustrated in FIG. 3 is terminated.

Figure 5:
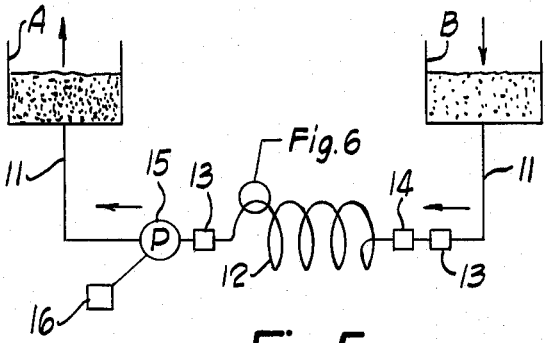
FIG. 5 is a diagrammatical showing of the apparatus as shown in FIGS. 1 and 3 but shows the operation of the pumping means to impart, while the helical portion of the conduit is still being spun, an axial flow of the slurry toward the opposite end of the helical portion, that is towards the left in FIG. 5. The state shown is at the end of step "c"
Figure 6:
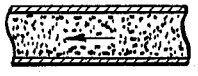
FIG. 6 illustrates the condition of the slurry at a cross-section of the conduit, indicated as location 6 in FIG. 5.

After the completion of that phase illustrated in FIG. 3 (axial flow to the right), the pump is suddenly reversed by the controller 16 whereby the pump 15 pumps the slurry in the opposite direction such as to the left in FIG. 5. This pumping of the slurry in the opposite direction such as to the left in FIG. 5, is also for a relatively short period of time, (such as generally in the range of about 0.1 to 10 seconds). The shortness of the successive pumping periods and consequent axial flow in opposite directions is such that the separation takes place without withdrawing all of the clearer liquid or less dense slurry from reservoir B. Clearer liquid or less dense slurry accumulates in reservoir B, and the slurry in reservoir A becomes denser or more concentrated.

It should be noted that all during the steps of no pumping and alternate pumping of the slurry in opposite directions, the spinning of the helical portion continues so that the slurry is constantly subjected to centrifugal force.

The sequence of operations after the system (reservoir and interconnecting conduit) has been supplied with slurry such as to the level illustrated in FIG. 1, is this:

During step "a" while there is no operation of the pump and no axial flow of the slurry, the rotator is operated to spin the helical portion and to impart centrifugal force on the slurry;

During a step "b" following the said step "a" and while the helical portion is still being spun, the pump is operated for a short period of time to induce an axial flow of slurry in one direction through the helical portion;

During step "c" immediately following said step "b" and while the helical portion is still being spun, the pump is operated for a short period of time to induce an axial flow of slurry in an opposite direction through the helical portion; and While the spinning of the helical portion continues, the above three steps "a", "b" and "c" of pumping action are repeated cyclically until the desired separation of liquid and fine particles has occurred. The volume of liquid ultimately accumulated in reservoir B, and the volume of concentrated slurry ultimately accumulated in reservoir A, depends on the initial volumes present in reservoirs A and B, and the cumulative sum of all of the volumes of rightward flows and the cumulative sum of all of the volumes of leftward flows in all of the cycles performed.

If after step "a" of spinning the helical tube without pumping the slurry and imposing an axial flow on it, the pumping of the slurry in step "b" is toward the direction of the reservoir B (to the right in FIG. 3), then ultimately after a continued sequential repetition of the above three steps as described, the clearer or less dense liquid will be located in reservoir B. Also, the denser or more concentrated slurry will be located in reservoir A.

Therefore, the controller 16 should be so operated as to produce the first axial flow imparted by pump 15 in the direction of that reservoir or receptacle where it is desired to receive and accumulate the liquid relatively free of fine particles.

The volume of fluid pumped toward reservoir B in step "b", which is equal to the volume pumped in the opposite direction toward reservoir A in step "c", may be varied over a broad range. The volume pumped may be a very small fraction of the volume of the helical tube, such as 1% or less, or it may be as large as being on the order of the volume of the helical tube. Small axial flows cause the separation to proceed relatively slowly, but the ultimate degree of separation achieved is relatively sharp. Large flows cause the separation to proceed relatively rapidly, but the ultimate degree of separation achieved is relatively less sharp.

Continuous Operation

A batch version of the invention has been described thus far. In most large scale industrial operations it is often desirable to make continuous the feed introduction and the product withdrawal.

Figure 7:
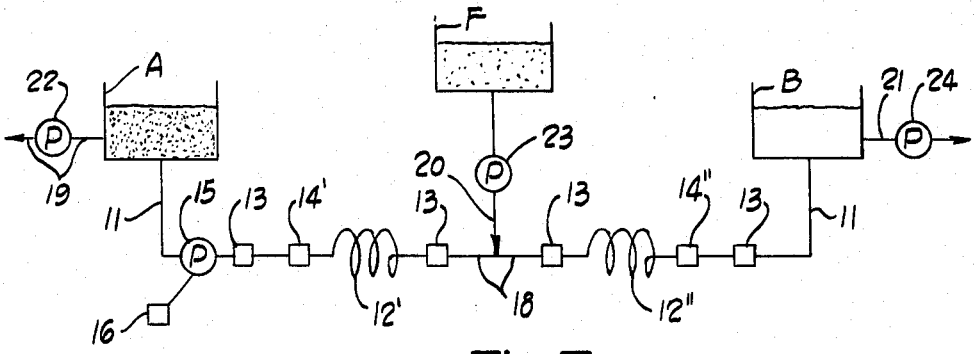
FIG. 7 is a diagrammatical showing of a continuous flow version of the invention.

For continuous operation the apparatus and process are modified slightly. The single helical tube 12 shown in FIG. 1 is replaced by two helical tubes 12' and 12'' as shown in FIG. 7. The two helical tubes may be spun by separate driving means 14' and 14'' or by means of a single driving means if the two helical tubes are supported by a single member such as a mandrel or a basket. The two helical tubes are connected by spinning seals 13 to a stationary conduit 18 where the feed is introduced from a feed means F. Additional conduits 19, 20 and 21 and pumping means 22, 23 and 24 enable continuous introduction of the feed and withdrawal of the two product streams.

The operation of the continuous version shown in FIG. 7 is similar to the operation of the batch version already described in FIGS. 1 through 6, with the addition that feed is admitted continuously and products are withdrawn continuously, or the feed and product streams may be introduced and withdrawn intermittently.

Fractionation

The cyclic repetition of the steps "a", "b" and "c" used in the example associated with FIG. 1 through FIG. 6 produces a concentrated slurry and a relatively clear liquid, i.e. the particles are concentrated in a portion of the fluid, and removed from the remaining fluid, regardless of the size and density of the particles. The invention can also be used to fractionate slurries, i.e. to separate a slurry into several portions each containing particles of different size, or different density, or different magnetic susceptibility, or different electric charge, or different die-electric constant. The key concept is to choose the design and operating variables such that the steps of separation and resuspension in cross-sections of the helical tube are partial, and not complete. For clarity, only centrifugal force is used in the following description of fractionation, but other separative forces such as magnetic and electric may also be used. Also for clarity, the discussion is in terms of particles and batch operation, but the same considerations apply to fractionation of emulsions and molecular mixtures and to continuous operation.

The concept of incomplete centrifugation is based on the fact that the largest and densest particles are centrifuged to the outer wall of the tube most readily. Therefore, if step "a" in FIG. 1 is terminated before centrifugation is complete, the smaller and less dense particles remain suspended and are transported with the pumped fluid at the beginning of step "b", while the larger and denser particles are immobilized against the wall. A Stokes law force balance on particles yields the speed at which particles move to the outer wall:

$$V = \frac{2}{9\mu} r^2 \Delta\rho G.$$

where

V = particle velocity $\mu$ = viscosity r = particle radius $\Delta\rho$ = density difference between particles and fluid G = centrifugal force per unit mass Hence, particles having the same value of $$r^2\Delta\rho$$

centrifuge at the same rate; at the end of step "a" modified for incomplete centrifugation, particles with large values of $r^2\Delta\rho$ are adjacent to the outer wall, but particles of small $r^2\Delta\rho$ remain suspended and are convected by subsequent axial flow. Incomplete centrifugation therefore enables particles to be separated according to their values of $r^2\Delta\rho$. Hence, particles with large $r^2\Delta\rho$ accumulate in reservoir A in FIG. 5 and particles with small $r^2\Delta\rho$ accumulate in reservoir B. The demarcation between large values of $r^2\Delta\rho$ and small values of $r^2\Delta\rho$ can be varied by changing the geometric, kinematic, and control variables, and the fluid properties. Decreasing G, increasing the helical tube diameter, increasing fluid viscosity, and decreasing the duration of step "a" (centrifugation without flow) all decrease the degree of centrifugation.

Incomplete resuspension can be achieved in two ways. One way is to select the design, operating, and control variables such that all of the particles are centrifuged to the outer wall in step "a", but only particles with small values of $r^2\Delta\rho$ are resuspended in step "b" because the secondary flows are limited in strength to velocities on the order of the velocity at which the separative force causes particles to segregate in the cross-section. Again, separation occurs according to $r^2\Delta\rho$, that is particles with small values of $r^2\Delta\rho$ accumulate in reservoir B and particles with large values of $r^2\Delta\rho$ accumulate in reservoir A.

Figure 8:
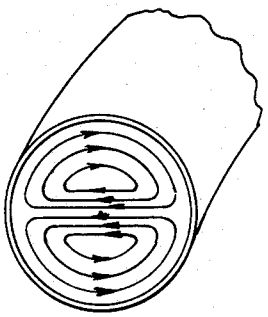
FIG. 8 is a sketch showing secondary flows in the cross-section of a helical tube under conditions where the direction of spinning and of pumping are coincident.

A second type of incomplete resuspension is achieved by selecting the design, operating, and control variables such that the secondary flows are strong enough to resuspend all of the particles in step "b", but to limit the duration of step "b" so that incomplete resuspension occurs. Let the axial flow and the spinning of the tube be in the same direction. Then, in step "b", the secondary flows will sweep particles along the tube wall, from the outer side to the inner side, and then into the tube cross section. See FIG. 8. Particles are swept along the wall with a velocity proportional to their radius, since larger particles extend further from the wall and contact faster moving fluid. The larger particles reach the middle of the cross section before the smaller ones, and separation of particles according to size occurs, independent of particle density.

The concepts of incomplete centrifugation and resuspension can be incorporated into a sequence of steps to fractionate polydisperse, multicomponent slurries. For simplicity, consider a slurry of two different sizes of particles having the same density. Step "a" is still a period of no pumping; both sizes of particles are centrifuged to the outer wall. Step "b" is a period of pumping from A to B within which clear liquid, large particles, and small particles begin to be transported sequentially. Initially only clear fluid moves because secondary flows are not yet established. Next, the secondary flows resuspend the larger particles according to the mechanism explained in the preceding paragraph. Finally, the smaller particles are also resuspended. Large particles are thus carried further than small particles. Step "c" is another period of centrifugation. Its duration is such that the larger particles are preferentially centrifuged whereas the smaller particles remain suspended. During step "d", fluid is pumped from B to A, transporting the smaller particles toward A. The pumping speed and step duration are chosen to suppress resuspension of the larger particles. If it is desired to have one of the product slurries be more concentrated than the other, an additional step "a" can be added between steps "a" and "b". Step "a" is a step of pumping clear fluid toward the reservoir where dilution is desired. The pumping rate is slow enough that particles are not resuspended. The net effect of repeating this sequence "a", "a'", "b", "c" and "d" is the accumulation of the larger particles in B and the smaller particles in A.

The example sequence "a", "a'", "b", "c" and "d" described above is a special form of the general class of cycle referred to earlier having at least one step of pumping in a first direction, and a second step of pumping in a second (reverse) direction. By modulating the flow rate (varying rates of positive and negative flow, including zero flow) and varying the duration of the cycle, the said general class of cycle can be adapted to fractionate slurries with multiple components. As in batch distillation, where components are withdrawn sequentially according to their volatility, the present invention can be used to produce slurry fractions with particles of different size, density, or other properties in each fraction.

Sharpness of Separation

Choices of design, operating, and control variables which bring about the desired separation or fractionation, but which do not produce as sharp a separation or fractionation as desired, can be improved by making the helical tube longer, while leaving all of the other design, operating, and control variables unchanged. A sharper separation is obtained because the number of separative stages is proportional to the volume of the helical tube divided by the volume of the fluid pumped forward or backward per cycle. The improvement in sharpness of separation is analogous to the improvement in separation obtained in distillation by adding more stages to a distillation column by increasing its length.

Emulsions And Molecular Mixtures

For clarity, the invention has been described thus far mainly in terms of solid particles more dense than the surrounding fluid. Particles less dense than the surrounding fluid can also be separated or fractionated. In the case of particles less dense than the surrounding fluid, when the separative force is centrifugal, the particles move to the inner wall under the influence of the separative force, i.e. to the part of the helical tube wall nearest to the axis of the helix, but otherwise the description of the separation mechanism does not change.

The separation or fractionation of emulsions containing droplets of liquid is the same as the separation of solid particles, except that liquid droplets can more easily coalesce or agglomerate when concentrated along a tube wall, and can form large droplets or even continuous phases which aid in the separation.

The same apparatus and process can also be used to separate molecular mixtures. To separate molecules effectively, the separative force applied in the cross-sectional plane of the tube should be as strong as possible, the cross-sectional area of the helical tube usually should be as small as possible, especially if the velocity of separation perpendicular to the axial direction is slow and the number of separative stages usually should be large. A large number of separative stages is achieved by making the ratio of the volume of the helical tube divided by the volume of fluid pumped forward or backward per cycle as large as possible, perhaps as great as 100,000 or more.

Magnetic, Electric, and Other Separative Forces

For clarity, the invention has been described thus far in terms of one separative force, centrifugal force. Centrifugal force is broadly applicable, but other separative forces can also be used, such as magnetic, electric, and light of different frequencies. The best choice depends upon the susceptibility of the mixture with respect to the various separative forces; usually the separative force for which the species to be separated is most susceptible is the best choice, tempered by other considerations such as the rate of degradation of the species being separated in the separative force field and the cost of providing the field.

Figure 9:
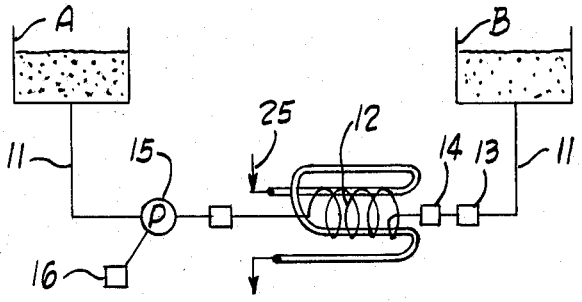
FIG. 9 is a diagrammatical showing of a version of the process in which a magnetic separative force is used. There are four conductors through which electric current flows in series.
Figure 10:
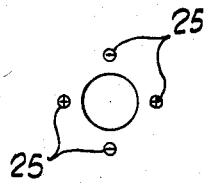
FIG. 10 is an end view of FIG. 9 showing only the helical tube and the four conductors.

For separating or fractionating magnetically susceptible materials, FIG. 9 and FIG. 10 show a batch version of the invention which uses a quadrupole magnetic field as a separative force. A large variety of types of magnetic field may be used as is well understood by those skilled in the art of magnetic field design, and the use of a quadrupole field as an example for purposes of illustration does not indicate a limitation on the type of magnetic field which may be used with the invention. The apparatus in FIG. 9 and FIG. 10 is the same as the apparatus previously described in FIG. 1 with the addition of four electrically conducting wires arranged parallel to the axis of the helix and symmetrically disposed outside of the helical tube as shown in FIG. 9 and FIG. 10. Electric current flows through all four wires which are connected in series. In FIG. 10, an end view, the direction of the electric current in each of the four wires is indicated by the sign + for flow in one direction, say downward, and by the sign − for flow in the opposite direction, say upward.

A quadrupole magnetic field disposed about the helical tube as shown has zero strength along the helix axis and increases in strength with increasing distance from the helix axis, so there is a gradient of magnetic field strength in the cross-sections of the helical tube. Magnetically susceptible species contained in the helical tube move toward the outer wall if they are ferromagnetic or paramagnetic, and toward the inner wall if they are diamagnetic, just as previously described particles moved under the influence of a centrifugal force field. Examples of magnetically susceptible materials are iron which is ferromagnetic, aluminum which is paramagnetic, and bismuth which is diamagnetic.

The single conductors shown for simplicity are in practice usually bundles of parallel wires, i.e. the electric circuit is repeated in parallel many times, and the parallel branches are series connected. The exact position of the four parallel wires in each parallel circuit may be offset one from another to enable a strong quadrupole magnetic field.

The helical tube itself should be made of a material with low magnetic susceptibility, and it may be filled with fine ferromagnetic steel wool in order to provide sharp gradients of the magnetic field as practiced in the refining of Kaolin clay by conventional high gradient magnetic separation processes.

Figure 11:
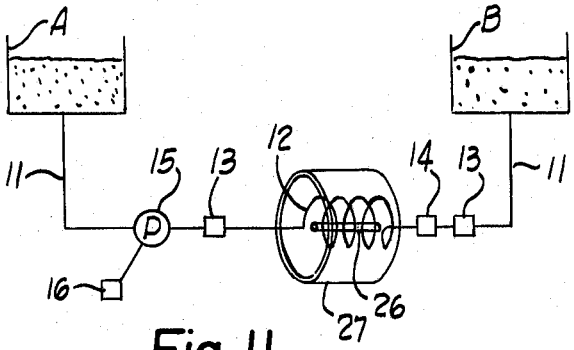
FIG. 11 is a diagrammatical showing of a version of the invention in which an electric separative force is used. There are two electrodes across which a high voltage is impressed.
Figure 12:
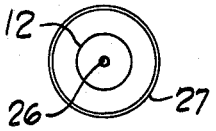
FIG. 12 is an end view of FIG. 11 showing only the helical tube and the two electrodes.

For separating or fractionating electrically susceptible materials, i.e. materials with different dielectric constants, FIG. 11 and FIG. 12 show a batch version of the invention which uses a coaxial electric field as a separative force. A large variety of types of electric fields may be used as is well understood by those skilled in the art of electric fields, and the use of a coaxial electric field as an example for purposes of illustration does not indicate a limitation on the type of electric field which may be used with the invention. The apparatus in FIG. 11 and FIG. 12 is the same as the apparatus previously described in FIG. 1 with the addition of one conductor such as a wire or rod along the helix axis and a second conductor such as a coaxial cylinder symmetrically disposed outside of the helical tube. The apparatus in FIG. 11 and FIG. 12 is the same as the apparatus in FIG. 1 with the addition of the coaxial conductors. One conductor, say the rod, is raised to a high voltage with respect to the other conductor, say the cylindrical tube.

A coaxial electric field disposed about the helical tube as shown decreases in strength with increasing distance from the helix axis, so there is a gradient of electric field strength in the cross sections of the helical tube. Electrically susceptible materials, i.e. those with high dielectric constants, move toward the inner wall of the helical tube, toward the higher field strength, analogous to the movement of low density material toward the inner wall in a centrifugal force field.

The practical use of an electric field with the invention requires that the fluid within the helical tube and the helical tube itself be substantially non-conducting.

Other separative forces in addition to centrifugal, magnetic, and electric may be used with the invention as will be recognized by those skilled in the art. The separative force is used to cause a concentration difference within the cross-sections of the helical tube. For example, light absorbed or scattered from atomic, ionic, molecular, and other small species of fine particles can cause such separations.

When a separative force other than centrifugal is used, the helical tube may be stationary or may spin slowly as discussed earlier. The operation of the equipment is as described in the examples given thus far, except that the centrifugal force field causing partial separation of species perpendicular to the walls of the helical tube is replaced by a magnetic, electric, or other separative force.

For clarity, the invention has been described thus far in terms of a curved conduit, particularly a helical tube. As previously explained, the curved conduit can be of any type, such as a tapered helical tube, a spiral tube, or even an irregularly curved tube, since these all enable secondary flow mixing to be induced by flow through the conduit. In its fullest generality, the invention can also be practiced in a straight tube by making the forward and backward flows within the cycles asymmetric in their flow rates. For example, if the forward flow is slow, species can continue to be held on or near the wall or packing surfaces by the separative force and the species will not be transported as rapidly as the flow through the tube; however, a relatively fast backward flow can mix a species held on or near a wall or packing surfaces into the bulk of the fluid where it is transported by the backward flow. In this way an asymmetric flow velocity brings about a periodic, asymmetric mixing of selected species into the bulk of the fluid and produces the same types of separations described earlier due to secondary flow mixing in curved conduits. When the invention is practiced in straight conduits, the separative force must be limited in strength, in order that relatively slow flows do not mix well or rapidly the separated species into the bulk of the fluid, but relatively fast flows rapidly mix the separated species into the bulk of the fluid. Often it is desirable that the relatively slow flow be in the laminar regime, and that the relatively fast flow be in the turbulent flow regime. A wide variety of cyclic flows can be used comprising in each cycle at least one step of forward flow and one step of backward flow through the circuit wherein at least one of the flows is faster in velocity than the other flows.

Combinations of Separative Forces

While the invention has been described thus far in terms of using a single separative force, it is clearly possible to use two or more separative forces simultaneously. For example, by using centrifugal and magnetic separative forces simultaneously, a component susceptible to centrifugal force can be separated simultaneously with a component susceptible to magnetic force, or a component susceptible to both forces can be separated in a single apparatus.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. Apparatus for the removal of fine particles from a slurry of the fine particles suspended in a liquid, comprising in combination a first container adapted to contain said slurry, a second container adapted to contain said slurry, a helical conduit in communication with both of said containers and adapted to provide passage for said slurry between said containers, rotating means for spinning said helical conduit on its axis to impart centrifugal force upon the slurry in said helical coil, seal means associated with said helical conduit to permit said helical conduit to spin while maintaining communication between said containers, pumping means for causing slurry to flow axially in said helical conduit between said containers, and control means for controlling the operation of the pumping means to provide a first period during the spinning of the helical conduit, to provide a second period during the spinning of the helical conduit, and to provide a third period during the spinning of the helical coil, said control means being timed to not have the pumping means operative during the said first period, to cause the pumping means to operate to cause axial flow of the slurry in a first axial direction in the helical coil during the said second period, and to cause the pumping means to cause axial flow of the slurry in an opposite direction during the said third period, said first, second and third periods being repeated cyclically, the cyclic repetition of the first, second, and third periods in cooperation with continued centrifugal force imparted on the slurry by the spinning helical conduit inducing fines suspended in the slurry to migrate to one of said containers.

2. Apparatus for causing fines in a slurry of fines suspended in a liquid to migrate and to leave liquid from which fines have migrated, comprising the combination of first and second containers adapted to hold said slurry, a conduit having a portion thereof formed in helical form, said conduit providing communication between said containers and adapted to hold said slurry, rotating means for rotating the helical portion of the said conduit on its axis and thus impart centrifugal force upon the slurry in the helical portion, pumping means for providing axial flow of the slurry in said helical portion, and control means for controlling the operation of the pumping means to provide a first period of rotation of the helical portion while the pumping means is not providing axial flow of the slurry in said helical portion, and after said first period to provide a second period alternating in succession the direction of the axial flow of the slurry by the pumping means while continuing the operation of the rotating means, and repeating cyclically the first period followed by the second period, the co-action of the axial flow and the centrifugal force imparted on the slurry creating such secondary flow of the slurry in the conduit that fines in the slurry migrate toward one of the said containers and away from the other container.

3. Apparatus as claimed in claim 2 and including seal means associated with the conduit for permitting the helical portion to be rotated by the rotating means while maintaining communication with the non-rotating parts of the conduit.

4. Apparatus as claimed in claim 2 in which said control means includes timing means to provide a cyclical operation of the pumping means to cause within the cyclic operation an initial period of rotation of the helical portion without imparting of axial flow by the pumping means, and thereafter alternate axial flow in opposite directions while continuing the rotation of the helical portion, whereby to subject the slurry to both the centrifugal force caused by the said rotation and to the said axial flow alternately in opposite directions for inducing secondary flow of the slurry in the conduit.

5. A process for separating fine particles from a slurry of such particles suspended in a liquid, comprising the steps of supplying the slurry to the interior of a conduit having a portion formed into a helical portion, spinning the helical portion on its axis to centrifugally force particles in the slurry to move radially outward toward the outer walls of the helical portion to concentrate near said outer walls, then after an initial period of spinning the helical portion, pumping said slurry in the conduit during a first period subsequent to said initial period of spinning the helical portion to impose an aixal flow of the slurry in the helical portion toward one end of the helical portion while continuing the spinning of the helical portion, and thereafter pumping said slurry in the conduit toward another end of the helical portion during a second period subsequent to said initial period of spinning the helical coil and while continuing the spinning of the helical portion, and, interspersed with periods of an absence of pumping, alternating in rapid succession the pumping in said alternate directions while continuing the spinning of the helical portion of the conduit, the changing axial flow and continued centrigual force inducing a migrating of the fine particles within the conduit to cause fine particles to move toward said another end of the helical portion.

6. The process as claimed in claim 5 and including the collection of liquid from said one end of the helical portion and the fine particles from said other end of the helical portion.

7. A process for separating the liquid and solid components of a mixture comprising the steps of introducing the mixture into an elongated chamber having an axis, subjecting the chamber and contained mixture to centrifugal force by rotating the chamber about the axis and which centrifugal force acts in a direction generally transverse to said axis, forcing the flow of said mixture in a first axial direction in said chamber for a first period of time while maintaining said centrifugal force, substantially immediately after said first period of time forcing the flow of said mixture in a second axial direction in said chamber for a second period of time while maintaining said centrifugal force, maintaining said centrifugal force on said chamber for a third period of time without axial flow in either of said first and second axial directions, and repeating the above described steps whereby the solid components travel to and concentrate at one end portion of said elongated chamber.

8. A process for separating the liquid and solid components of a mixture comprising the steps of introducing the mixture into an elongated chamber having an axis, subjecting the chamber and contained mixture to centrifugal force by rotating the chamber about the axis and which centrifugal force acts in a direction generally transverse to said axis and causes the solid components to travel toward the wall of the chamber, forcing the flow of said mixture in a first axial direction in said chamber for a first period of time while maintaining said centrifugal force, flow of said mixture in said first axial direction during the first part of said first time period causing the mixture which flows to contain relatively less of said solid components, flow of said mixture in said first axial direction during the last part of said first time period causing secondary flow in the chamber with resultant movement of the solid components from the wall of the chamber to the central portion of the chamber, substantially immediately after said first period of time forcing the flow of said mixture in a second axial direction opposite to said first axial direction in said chamber for a second period of time while maintaining said centrifugal force, the mixture which flows in said second axial direction during said second period of time containing relatively more of said solid components than in the mixture which flows in said first axial direction, maintaining said centrifugal force on said chamber for a third period of time without axial flow in either of said first and second axial directions, and repeating the above described steps whereby the solid components travel to and concentrate at one end portion of said elongated chamber.

9. A process as claimed in claim 8 wherein said elongated chamber is in the form of helices, partial helices, spirals or partial spirals.

10. A process for separating a slurry-mixture into first and second portions comprising the steps of introducing the slurry-mixture into an elongated chamber having a generally helical or spiral shape and having an axis, subjecting the chamber and contained slurry-mixture to centrifugal force by rotating the chamber about the axis and which centrifugal force acts in a direction generally transverse to said axis, forcing the flow of said slurry-mixture in a first axial direction in said chamber for a first period of time while maintaining said centrifugal force, substantially immediately after said first period of time forcing the flow of said slurry-mixture in a second axial direction in said chamber for a second period of time while maintaining said centrifugal force, maintaining said centrifugal force on said chamber for a third period of time without axial flow in either of said first and second axial directions, and repeating the above described steps whereby a first portion of said slurry-mixture travels to one end of said chamber and a second portion of said slurry-mixture more concentrated than the first portion travels to the other end of said chamber.

* * * * *